US008517776B1

(12) United States Patent
Flojo

(10) Patent No.: US 8,517,776 B1
(45) Date of Patent: Aug. 27, 2013

(54) GROUND CLAMP FOR USE WITH BALL STUD GROUND CONDUCTORS

(75) Inventor: Alfred Flojo, Chicago, IL (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 13/413,362

(22) Filed: Mar. 6, 2012

(51) Int. Cl.
*H01R 4/30* (2006.01)

(52) U.S. Cl.
USPC ..... 439/803; 439/108; 439/228; 439/477

(58) Field of Classification Search
USPC ..... 439/108, 228, 477, 803
See application file for complete search history.

(56) References Cited

U.S. PATENT DOCUMENTS 1,543,391 A * 6/1925 Knopke ..... 52/153
2,250,530 A * 7/1941 Hafecost ..... 226/141
4,911,572 A * 3/1990 Williams ..... 403/209
5,152,701 A * 10/1992 Polidori ..... 439/791
5,547,404 A * 8/1996 Nellis et al. ..... 439/803
6,315,278 B1 * 11/2001 Gaztanaga ..... 269/228
8,317,536 B2 * 11/2012 Flojo ..... 439/477
2011/0081810 A1 * 4/2011 Flojo ..... 439/803

OTHER PUBLICATIONS

Hi-Line Utility Supply Co. Catalog, pp. 130-143.

* cited by examiner

*Primary Examiner* — James Harvey
(74) *Attorney, Agent, or Firm* — Wood, Phillips, Katz, Clark & Mortimer

(57) ABSTRACT

A ground clamp (10) is provided for use with a ball stud (12) having a shaft (14) that terminates in a spherical end (16), and includes a body (20), a first jaw (22), and a second jaw (24). The first jaw (22) includes two fingers (40) that define a slot (44) through which the shaft (14) can extend when the ball stud is inserted into the clamp. The second jaw includes a laterally extending platform (50) and a rib (52) extending from the platform to be located within the slot with the jaws in a closed position. The second jaw has a concave clamp surface (54) defined in the platform (50) and the rib (52) that is engageable with the spherical end as the second jaw moves to the closed position to guide the jaws and the spherical end into proper alignment.

12 Claims, 3 Drawing Sheets

GROUND CLAMP FOR USE WITH BALL STUD GROUND CONDUCTORS

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD

This disclosure relates to grounding assemblies used in the electrical utility industry as protective-grounding equipment, and more particularly to ground clamps for use with ball stud ground conductors.

BACKGROUND

Grounding assemblies including various types of clamps, ferrules, and interconnecting electrically conducting conduits in the form of cables are commonly used as protective equipment for lineworker or other personnel working around electric power lines. Ground clamps for use with ball stud ground conductors having a shaft that terminates in a spherical end are known. Such clamps are typically so call C-type clamps having a pair of generally C-shaped jaws that clamp the spherical end of the ball stud with the shaft of the ball stud extending through a pair of fingers that forming one of the jaws of the clamp. An example of such a clamp, as well as some ball studs, is shown in commonly owned, published U.S. patent application, Pub. No. US 2011/0081810, published Apr. 7, 2011.

When using ground clamps with ball studs, it is important that the jaws and the spherical end of the ball stud be properly aligned in the clamped condition. An improperly aligned clamp/spherical end can lead to an unintended release of the ball stud during lineworker maintenance or during a ground fault, which can create an unsafe situation.

SUMMARY

In accordance with one aspect of this disclosure, a ground clamp is provided for use with a ball stud, the ball stud having a shaft that terminates in a spherical end having a diameter larger than a diameter of the shaft. The ground clamp includes a body connectable to an electrical conduit to provide an electrically conductive connection, and first and second jaws extending from the body and movable relative to each other between an open position wherein a spherical end of a ball stud may be inserted into the clamp and a closed position wherein the spherical end of the ball stud can be clamped between the jaws to provided an electrically conductive connection between the clamp and the ball stud. The first jaw includes two fingers, each finger defining a C-shaped clamp surface that abuts the spherical end of the ball stud when the ball stud is inserted into the clamp. The two fingers are laterally spaced from each other to define a slot extending between the fingers and having a lateral width through which a shaft of the ball stud can extend when the ball stud is inserted into the clamp. The second jaw includes a laterally extending platform having a lateral width greater than the lateral width of the slot. The second jaw further includes a rib extending from the platform to be located within the slot between the two fingers with the jaws in the closed position. The second jaw has a concave clamp surface defined in the platform and the rib that partially surrounds the spherical end of the ball stud with the jaws in the closed position and the ball stud inserted in the clamp. The concave clamp surface on the rib is engageable with the spherical end of the ball stud as the jaws move from the open position to the closed position to guide the jaws and the spherical end of the ball stud into proper alignment in the closed position with the ball stud inserted into the clamp.

As one feature, the concave clamp surface is spherically shaped.

In one feature, the platform has a planar surface surrounding the concave clamp surface in the platform, and the concave clamp surface in the rib extends above the planar surface.

According to one feature, the jaws are translatable relative to each other along a longitudinal axis.

In a further feature, the platform has a planar surface surrounding the concave clamp surface in the platform and extending transverse to the longitudinal axis, and the concave clamp surface in the rib extends above the planar surface.

As one feature, the first jaw is fixed relative to the body and the second jaw is translatable relative to the body along the longitudinal axis.

According to one feature, the first jaw and the body are a one-piece component of the clamp.

As one feature, the ground clamp further includes a threaded member mounted in the body for rotation and extending parallel to the longitudinal axis, the threaded member operably engaged with the second jaw to translate the second jaw between the open and closed positions in response to rotation of the threaded member.

As a further feature, the second jaw includes a threaded boss engaged with the threaded member.

In one feature, the ground clamp further includes an actuating member operably associated with the jaws to actuate the jaws between the open and closed positions.

According to one feature, the body further includes a boss configured to receive an end of an electrical conduit to form an electrically conductive connection with the electrical conduit.

Other features and advantages will become apparent from a review of the entire specification, including the appended claims and drawings.

DETAILED DESCRIPTION

Figure 4:
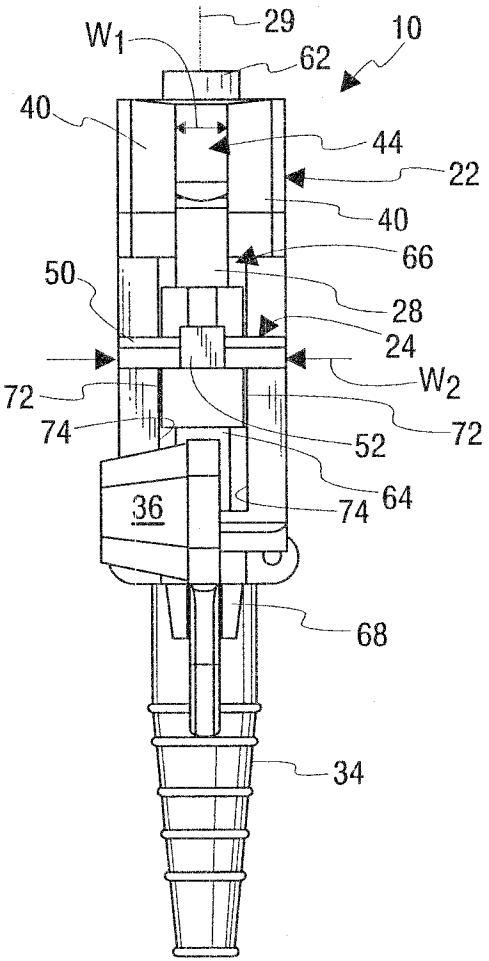
FIG. 4 if a front elevation of the ground clamp of FIGS. 1-3, with the clamp again shown in the open condition.
Figure 1:
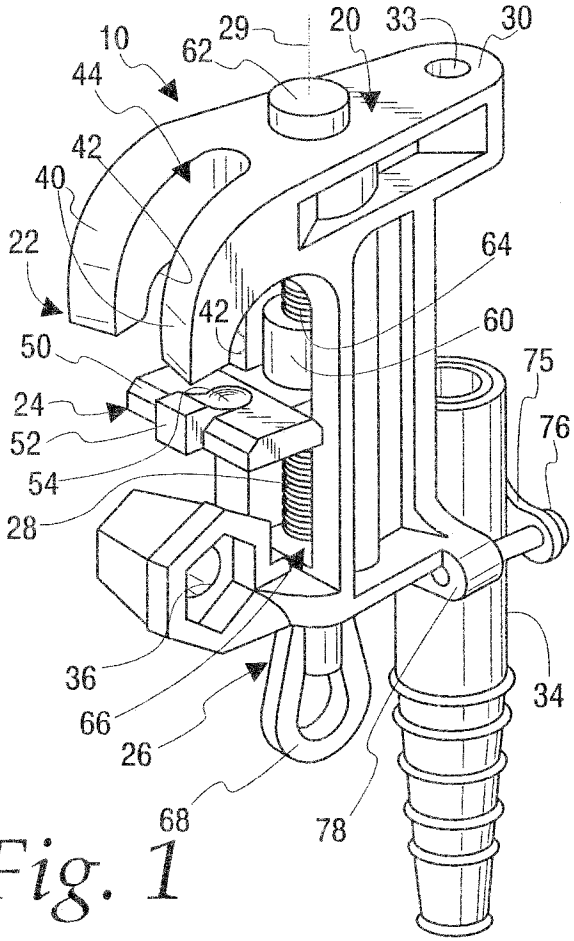
FIG. 1 is a perspective view of a ground clamp according to this disclosure, with the clamp shown in an open condition.
Figure 3:
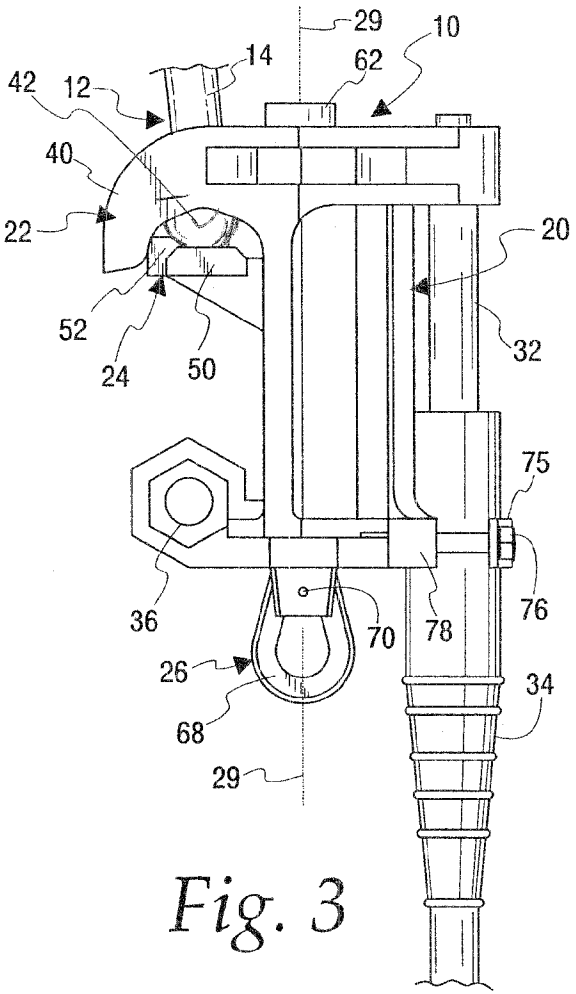
FIG. 3 is a view similar to FIG. 2, but showing the clamp in a closed or clamped condition, with a ball stud clamped therein.
Figure 2:
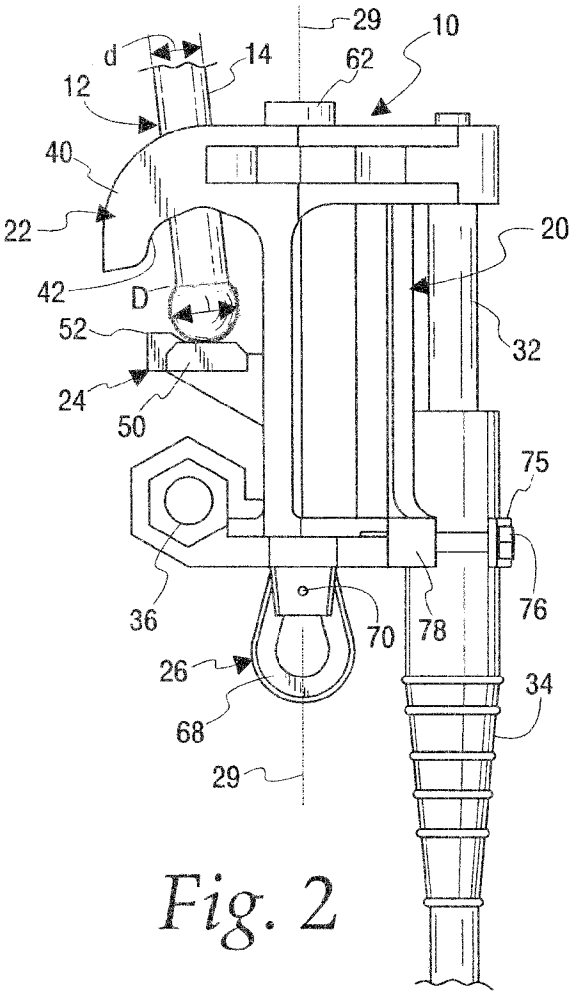
FIG. 2 is a side elevation of the ground clamp of FIG. 1, with the clamp again shown in an open condition.

With reference to FIGS. 1-3, a ground clamp 10 is shown for use with a ball stud 12, the ball stud 12 being of any conventional and known construction and having a shaft 14 that terminates in a spherical ball or end 16 having a diameter D larger than the shaft diameter d. The ground clamp 10 includes a body 20, a first or upper jaw 22, a second or lower jaw 24, and an actuating member 26, operably associated with the jaws 22 and 24 to actuate the clamp 10 between the open position shown in FIGS. 1, 2 and 4 and the clamped or closed position shown in FIG. 3. In the open position, the spherical end 16 of the ball stud 12 can be inserted into the clamp and in the closed position, the spherical end 16 of the ball stud 12 is clamped between the jaws 22 and 24 to provide an electrically conductive connection between the clamp 10 and the ball stud 12. In the illustrated embodiment, the actuating member 26 is shown in the form of a threaded screw member 28 extending along a longitudinal axis 29.

The body 20 includes a boss 30 for connection to an electrical conduit, shown diagrammatically at 32 in FIGS. 2 and 3, to provide an electrically conductive ground connection between the clamp 10 and the electrical ground conduit 32. While any suitable construction can be used to provide the electrically conductive ground connection between the clamp 10 and the conduit 32, in the illustrated embodiment the boss 30 has a bore 33 for receiving an end of the conduit 32. The clamp 10 can further include a strain relief sleeve 34 of any conventional and known construction through which the electrical conduit 32 extends and which serves to reduce and/or relieve the strain on the electrical conduit 32 as it extends from the clamp 10. The body 20 can further include an internally threaded boss 36 for receiving the threaded end of another ball stud (not shown).

The jaw 22 includes two fingers 40, with each finger 40 defining a C-shaped shaped clamp surface 42 that abuts the spherical end 16 of the ball stud 12 when the ball stud 12 is inserted into the clamp 10. The two fingers 40 are laterally spaced from each other to define an open ended slot 44 extending between the fingers 40 and having a lateral (perpendicular to the axis 29) width $W_1$ through which the shaft 14 of the ball stud 12 can extend when the ball stud 12 is inserted into the clamp 10. In the illustrated embodiment, the housing 20 and the jaw 22, including the two fingers 40, are a one-piece component of the clamp 10.

Figure 7:
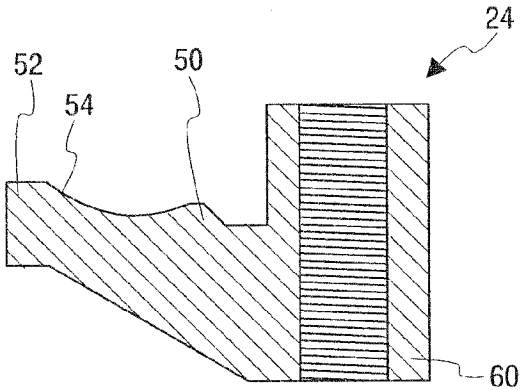
FIG. 7 is a section view taken along line 7-7 in FIG. 5.
Figure 6:
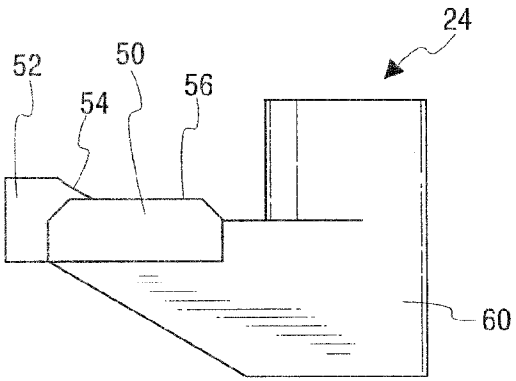
FIG. 6 is a side view of the jaw component of FIG. 5.

The second jaw 24 includes a laterally extending platform 50 having a lateral width $W_2$ greater than the lateral width $W_1$ of the open ended slot 44. The jaw 24 further includes a rib 52 extending from the platform 50 to be located within the open ended slot 44 between the two fingers 40 with the jaws 22 and 24 in the closed position. The second jaw 24 has a concave clamp surface 54 defined in the platform 50 and the rib 52 that partially surrounds the spherical end 16 of the ball stud 12 with the jaws 22 and 24 in the closed position. In this regard, in the illustrated embodiment, the concave clamp surface 54 is spherically shaped and sized to conform to the spherical end 16 of the ball stud 12. The concave clamp surface 54 on the rib 52 is engageable with the spherical end 16 of the ball stud 12 as the jaws 22 and 24 move from the open position to the closed position to guide the jaws 22 and 24 and the spherical end 16 into proper alignment in the closed position with the ball stud 12 inserted into the clamp 10. The platform 52 has a planar surface 56 surrounding the concave clamp surface 54 and the concave clamp surface 54 and the rib 52 extends above the planar surface 56, as best seen in FIGS. 6 and 7.

The threaded screw member 28 is offset from the clamp surfaces 42 and 54, and the jaw 24 includes an internally threaded boss 60 that is engaged with the threaded member 28 so that the jaw 24 will translate between the open and closed positions parallel to the axis 29 in response to rotation of the threaded member 28. In the illustrated embodiment, the threaded member 28 includes an enlarged portion 62 that abut an upper surface of the body 20, a threaded shaft 64 that extends downwardly through a channel 66 formed in the body 20, and an eye component 68 that is rotationally fixed to the shaft 64, such as by a spring pin 70, and abuts a lower surface of the body 20. The jaw 24 includes parallel side walls 72 extending from the boss 60 to the platform 50 that slidably engage side walls 74 of the channel 66 to maintain alignment of the jaw 24 relative to the housing 20 and to react torsional forces generated when the threaded member 28 is rotated to translate the jaw 24 between the open and closed positions. It will be appreciated by those skilled in the art that the eye component 68 is engageable by one or more common tools employed by lineworkers. It should also be appreciated that while the threaded member 28 is shown as being offset relative to the clamp surfaces 42 and 54, other constructions are possible, including one wherein the threaded member 28 underlies and/or is aligned with the clamp surfaces 42 and 54. An example of such a construction is shown in previously referenced and commonly owned published U.S. patent application, Publication No. US 2011/0081810, published Apr. 7, 2011.

While any suitable mount construction can be used, the strain relief sleeve 34 is mounted via a bracket 75 and two bolts 76 that are received in threaded bosses 78 formed on the body 20 (only one bolt 76 and one boss 78 shown).

Figure 5:
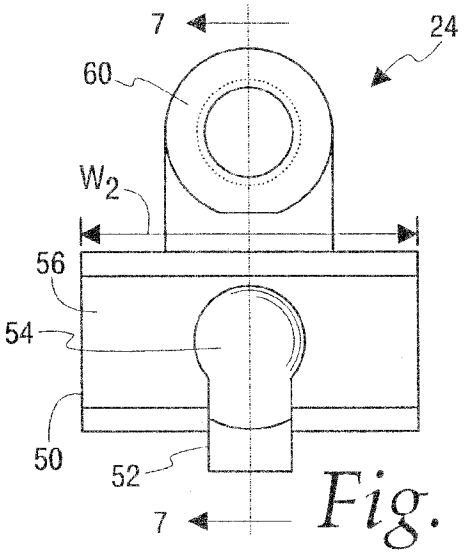
FIG. 5 is an enlarged top view of a movable jaw component of the clamp of FIGS. 1-4.
Figure 8:
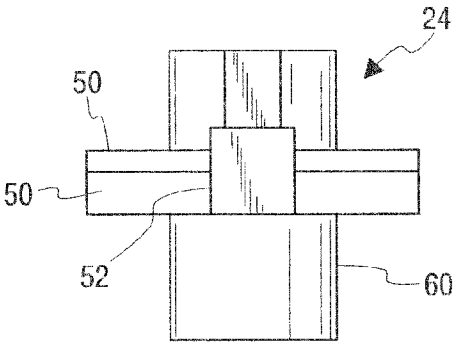
FIG. 8 is a front view of the jaw of FIGS. 5-7.

It should be understood that while certain embodiments have been illustrated and described herein, there are many possible forms for the various features of the clamp 10. For example, while the actuating member 26 is shown in the form of the threaded member 28, there are other possible constructions for an actuating member 26 that can move the jaws 22 and 24 relative to each other between the open and closed positions and that may be desirable depending upon the particular parameters of each application. As another example, while the platform 50 is shown as being rectangular when viewed from above, as best seen in FIG. 5, there are many possible shapes for the platform that may be desirable depending upon the particular parameters of each particular application. Accordingly, no limitation to any specific embodiment is intended unless it is expressly recited in one of the appended claims.

The invention claimed is:

1. A ground clamp for use with a ball stud, the ball stud having a shaft that terminates in a spherical end having a diameter larger than a diameter of the shaft, the ground clamp comprising:

a body connectable to an electrical conduit to provide an electrically conductive connection;

first and second jaws extending from the body and movable relative to each other between an open position wherein a spherical end of a ball stud may be inserted into the clamp and a closed position wherein the spherical end of the ball stud can be clamped between the jaws to provided an electrically conductive connection between the clamp and the ball stud;

the first jaw including two fingers, each finger defining a C-shaped clamp surface that abuts the spherical end of the ball stud when the ball stud is inserted into the clamp, the two fingers being laterally spaced from each other to define a slot extending between the fingers and having a lateral width through which a shaft of the ball stud can extend when the ball stud is inserted into the clamp; and the second jaw including a laterally extending platform having a lateral width greater than the lateral width of the slot, the second jaw further including a rib extending from the platform to be located within the slot between the two fingers with the jaws in the closed position, the second jaw having a concave clamp surface defined in the platform and the rib that partially surrounds the spherical end of the ball stud with the jaws in the closed position and the ball stud inserted in the clamp, the concave clamp surface on the rib engageable with the spherical end of the ball stud as the jaws move from the open position to the closed position to guide the jaws and the spherical end of the ball stud into proper alignment in the closed position with the ball stud inserted into the clamp.

2. The ground clamp of claim 1 wherein the concave clamp surface is spherically shaped.

3. The ground clamp of claim 1 wherein the platform has a planar surface surrounding the concave clamp surface in the platform, and the concave clamp surface in the rib extends above the planar surface.

4. The ground clamp of claim 1 wherein the jaws are translatable relative to each other along a longitudinal axis.

5. The ground clamp of claim 4 wherein the platform has a planar surface surrounding the concave clamp surface in the platform and extending transverse to the longitudinal axis, and the concave clamp surface in the rib extends above the planar surface.

6. The ground clamp of claim 4 wherein the first jaw is fixed relative to the body and the second jaw is translatable relative to the body along the longitudinal axis.

7. The ground clamp of claim 6 wherein the first jaw and the body are a one-piece component of the clamp.

8. The ground clamp of claim 6 further comprising a threaded member mounted in the body for rotation and extending parallel to the longitudinal axis, the threaded member operably engaged with the second jaw to translate the second jaw between the open and closed positions in response to rotation of the threaded member.

9. The ground clamp of claim 8 wherein the second jaw includes a threaded boss engaged with the threaded member.

10. The ground clamp of claim 1 further comprising an actuating member operably associated with the jaws to actuate the jaws between the open and closed positions.

11. The ground clamp of claim 1 wherein the body further includes a boss configured to receive an end of an electrical conduit to form an electrically conductive connection with the electrical conduit.

12. The ground clamp of claim 1 wherein the slot is an open ended slot.

* * * * *